US005538046A

United States Patent [19]

Bassi et al.

[11] Patent Number: 5,538,046

[45] Date of Patent: Jul. 23, 1996

[54] MECHANISM FOR CONTROLLING THE RECIPROCATING MOVEMENT OF GRIFFE FRAMES

[75] Inventors: Dario Bassi, Chaponnay; Damien Bouchet, Decines, both of France

[73] Assignee: Staubli Lyon, Chassieu, France

[21] Appl. No.: 399,480

[22] Filed: Mar. 7, 1995

[30] Foreign Application Priority Data

Mar. 10, 1994 [FR] France ..... 94 03026

[51] Int. Cl.[6] ..... D03C 3/08; D03C 3/36

[52] U.S. Cl. ..... 139/59; 139/65

[58] Field of Search ..... 139/59, 65

[56] References Cited

U.S. PATENT DOCUMENTS

| | | | |
|---|---|---|---|
| 4,936,352 | 6/1990 | Keim | 139/59 |
| 5,103,873 | 4/1992 | Bassi | 139/59 |

FOREIGN PATENT DOCUMENTS

| | | | |
|---|---|---|---|
| 899929 | 11/1953 | Germany | 139/59 |
| 1535220 | 12/1970 | Germany | 139/59 |
| 433139 | 9/1967 | Switzerland | 139/59 |
| 986770 | 3/1965 | United Kingdom | 139/59 |
| 1032014 | 6/1966 | United Kingdom | 139/59 |

*Primary Examiner*—Andy Falik
*Attorney, Agent, or Firm*—Dowell & Dowell

[57] ABSTRACT

A mechanism for controlling the reciprocating movement of griffe frames of a weaving system including a control shaft on which first and second sets of two complementary cams are mounted in opposite angular relationship with respect to one another by approximately 180°. Each cam corporates with a follower roller mounted on first and second sets of double rocker levers which are connected to two griffe frames by first and second sets of connecting rods.

7 Claims, 3 Drawing Sheets

MECHANISM FOR CONTROLLING THE RECIPROCATING MOVEMENT OF GRIFFE FRAMES

BACKGROUND OF THE INVENTION

FIELD OF THE INVENTION

The present invention relates to improvements in or relating to mechanisms for controlling the reciprocating movement of the griffe frames of a weaving system.

HISTORY OF THE RELATED ART

Around 1975, Applicants developed and used a mechanism for controlling the reciprocating movement of the griffe frames of a weaving system incorporating rotating hooks, called CR 520, essentially constituted by a set of two complementary cams mounted on the control shaft of the system in which each cam cooperates with a follower roller mounted on a rocking lever pivoting freely about an in axis. Each rocker is connected to each griffe frame by two complementary connecting rods, long and short respectively. A set of two complementary cams were provided on each side of the frame of the machine. The ends of the rods opposite those controlled by the double rocking lever were articulated at the center of the griffe frames which were, guided by appropriate members for them to move either in parallel or obliquely with respect to each other.

Such a construction, which comprises a large number of guiding parts, involves an excessive cost, an imprecise movement of the frames and a poor overall mechanical yield. Moreover, it is difficult to apply to a system of large dimensions.

The object of the improvements according to the present invention is to provide a control mechanism of the type in question which is applicable to griffe frames in large dimensions and of which guiding is reduced to a strict minimum.

SUMMARY OF THE INVENTION

To that end, the control mechanism according to the invention is characterized in that the cam-bearing shaft is provided on each side of the frame with a second set of two complementary cams offset angularly by 180° with respect to the first set, each cooperating with a follower roller mounted on a second double rocker placed side by side with the first and which is connected to each griffe frame by means of two connecting rods, long and short, respectively, so that one griffe frame is driven by the two short rods of the rockers while the long rods drive the other griffe frame.

Because of this arrangement, the mechanism maybe located at the bottom of the chassis of the weaving system so as to disposed in a casing so as to ensure the splash lubrication thereof.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
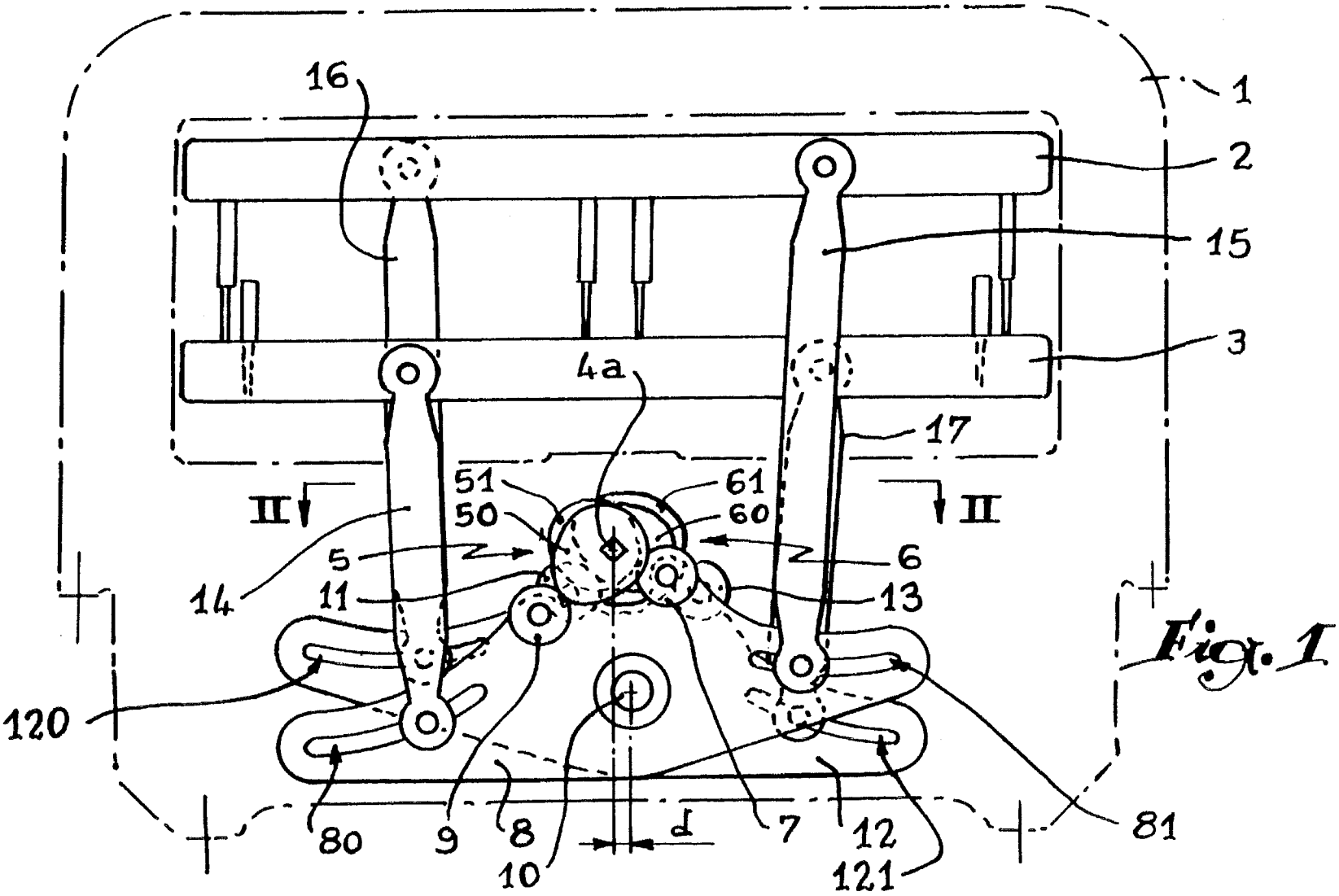
FIG. 1 is a view in elevation of a portion of the control mechanism of the invention located on one side of the frame of the weaving machine.
Figure 2:
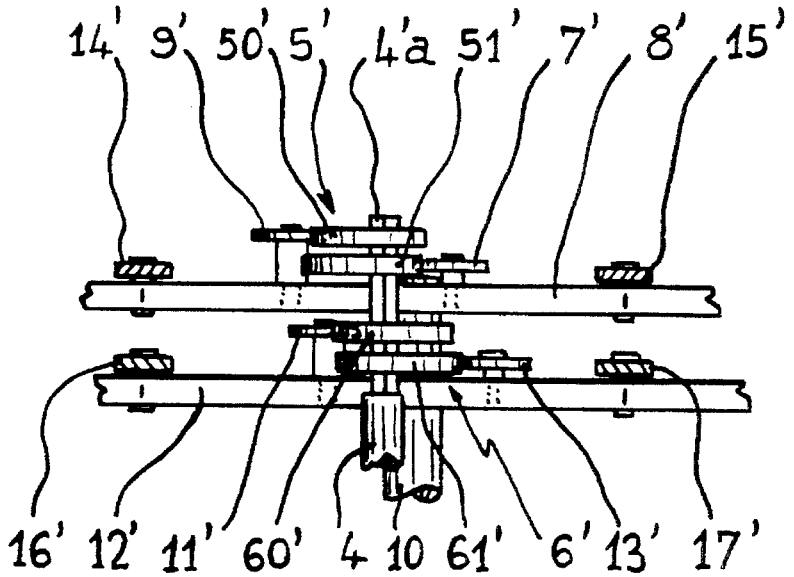
FIG. 2 is a schematic section along II—II (FIG. 1) showing the arrangement of the complementary cams on either side of the frame of the machine to which the invention is applied.
Figure 2:
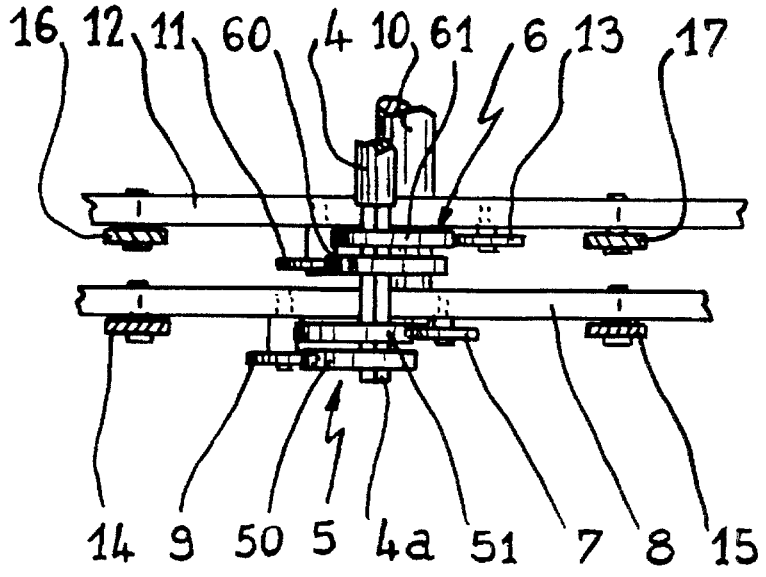

Referring now to the drawings, FIG. 1 schematically shows the frame 1 of a weaving system comprising two griffe frames 2, 3 moving vertically in reciprocating manner by a mechanism according to the invention. This mechanism comprises two identical assemblies located on each side of the frame 1, as illustrated in FIG. 2.

At the base of f came 1 there is provided a transverse control pin or shaft driven in rotation in conventional manner from the weaving loom with which the system shown is associated. Control shaft 4 comprises at each of its ends projecting out of the frame a quadrangular endpiece 4*a* on which are fitted two groups 5, 6 of two complementary cams. The first, outermost group 5 comprises two complementary cams 50 and 51 placed side by side. The second group 6, placed innermost on the endpiece 4*a*, is composed of two complementary cams 60, 61.

The same structure is found on the other side of the fame, symmetrically with respect to its longitudinal axis. Of course, and for reasons which will be better explained hereinbelow, the two groups of cams 5 and 6 are offset by 180°.

The periphery of cam 50, of appropriate profile, cooperates with a follower roller 7 secured to a two-arm rocker 8, while the periphery of the cam 51 is in contact with a follower roller 9, likewise secured to the rocker 8. The rocker is mounted to pivot about a transverse support shaft 10.

The same arrangement is found for the group of cams 6. The periphery of can 61 is in permanent abutment against a follower roller 11, mounted on a second rocker 12 pivoting about shaft 10 in the immediate proximity of the first rocker 8. The second cam 61 cooperates with a second follower roller 13 likewise mounted on rocker 12.

Under these conditions, when shaft 4 rotates, driving the four cams 50, 51, 60 and 61 in rotation, the rockers 8 and 12 are reciprocatingly pivoted in known manner about their axis and control shaft 10. In that case, it suffices to join the rockers to the two griffe frames 2 and 3 to cause them to move reciprocatingly in the vertical direction. To that end, one of the arms of the rocker 8, for example the left-hand one in FIG. 1, is pivotally associated with a short lever 14 of which the other end is articulated on the lower griffe frame 3. On the second arm of the rocker 8 (the right-hand one in FIG. 1) there is articulated the first end of a lever 15 of which the other end is articulated on the upper griffe frame 2.

The second rocker 12 is, articulated by its first arm on a connecting rod 16 disposed to the side of the connecting rod 14 and likewise articulated on the upper griffe frame 2. The second arm of the rocker 12 is associated with the lower frame 3 via a connecting rod 17.

It will be observed that the connecting rods 14 and 17 are short and of the same length, while connecting rods 15 and 16 are long and likewise of the same length. The movement of oscillation of the rockers 8 and 12 via the cams thus provokes the vertical reciprocating displacement, in opposite directions, of the griffe frames 2 and 3.

It will be noted that the two arms of the two rockers comprise curved slots 80, 81 and 120, 121, respectively, in which the lower ends of the four connecting rods are mounted to pivot. It is obvious that, by changing the position of the lower ends of the four connecting rods with respect to the slots of the rockers, either the stroke of the two frames 2 and 3, or their obliquity, is varied.

For technical reasons facilitating construction, the geometrical axes of pins 4 and 10 may be offset laterally by a value d, but without departing from the scope of the invention, the two geometrical axes may lie in the same vertical plane.

FIG. 2 indicates the locations of the components symmetrical to those described hereinabove with the same references, bearing an accents.

Figure 3:
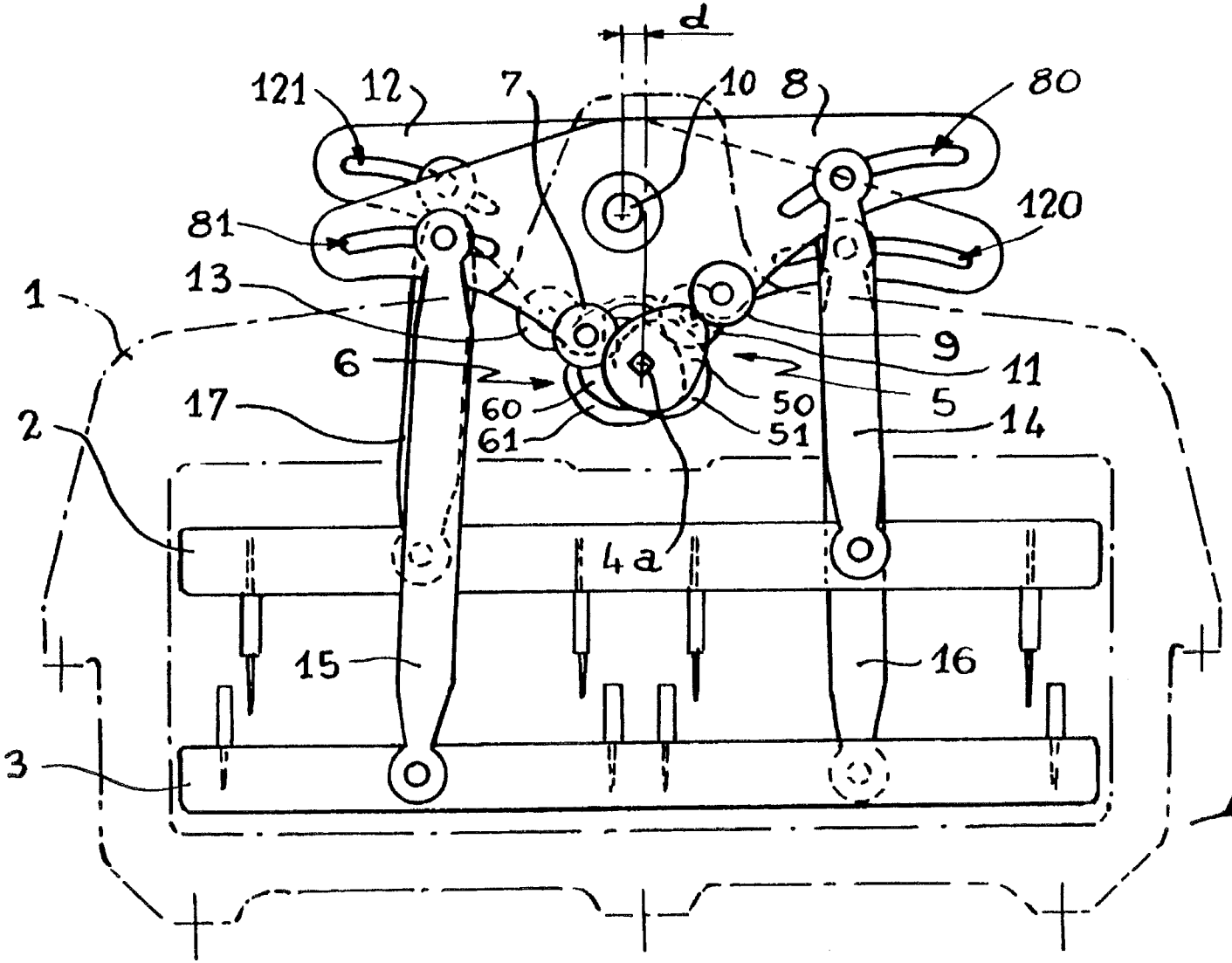
FIG. 3 is a view similar to that of FIG. 1, but illustrating a variant embodiment.

In particular, it is possible, as illustrated in FIG. 3, to place the assembly of the mechanism at the top of the chassis. Under these conditions, it is the short connecting rods 14, 17 which join the rockers 8, 12 to the upper griffe frame 2, while the long connecting rods 15, 16 join said rockers 8, 12 to the lower griffe frame 3.

What is claimed is:

1. A mechanism for controlling the reciprocating movement of griffe frames of a weaving system in which the weaving system has a frame having upper and lower portions, comprising; a control shaft having opposite end portions, a pair of first complementary cams mounted to each of said opposite end portions of said control shaft, said first complementary cams engaging first follower rollers carried by a pair of first double rocker levers, each of said first double rocker levers being pivotably mounted about a support shaft, first pairs of first and second connecting rods for connecting each of said first double rocker levers to first and second griffe frames, respectively, each of said first connecting rods being relatively shorter than said second connecting rods, a pair of second complementary cams mounted to said opposite end portions of said control shaft offset angularly approximately 180° with respect to said pair of first complementary cams, each of said second complementary cams engaging second follower rollers carried by a pair of second double rocker levers, said second double rocker levers being pivotably mounted adjacent said first double rocker levers, second pairs of first and second connecting rods for connecting said second double rocker levers to said first and second griffe frames, respectively, whereby said first griffe frame is drivingly connected to said first connecting rods and said second griffe frame is drivingly connected to said second connecting rods.

2. The mechanism of claim 1 wherein said control shaft and said support shaft are horizontally offset with respect to one another.

3. The mechanism of claim 1 wherein each of said first and second double rocker levers include oppositely oriented arms having slots formed therein, said first and second pairs of said first and second connecting rods being adjustably mounted within said slots of said oppositely oriented arms.

4. The mechanism of 3 in which said slots are curved.

5. The mechanism of 3 wherein said control shaft and said support shaft are horizontally offset with respect to one another.

6. The mechanism of claim 1 wherein said first and second double rocker levers are adapted to be mounted within the upper portion of the frame of the weaving system.

7. The mechanism of claim 1 wherein said first and second double rocker levers are adapted to be mounted within the lower portion of the frame of the weaving system.

* * * * *